US006053829A

United States Patent [19]

Conley

[11] Patent Number: 6,053,829

[45] Date of Patent: Apr. 25, 2000

[54] GAME BALL AND METHOD OF PLAYING A GAME

[76] Inventor: James Conley, 10745 Borgman, Huntington Woods, Mich. 48070

[21] Appl. No.: 09/069,499

[22] Filed: Apr. 29, 1998

[51] Int. Cl.[7] ..... A63B 43/00

[52] U.S. Cl. ..... 473/594; 473/593

[58] Field of Search ..... 473/594, 577, 473/593, 595, 610, 611; 5/655.4, 702, 911, 913; 297/452.17, DIG. 1

[56] References Cited

U.S. PATENT DOCUMENTS

| | | | |
|---|---|---|---|
| 3,595,948 | 7/1971 | Cosani . | |
| 3,762,404 | 10/1973 | Sakita | 5/913 |
| 3,924,856 | 12/1975 | Dekan et al. | 473/594 |
| 4,011,611 | 3/1977 | Lederman | 473/594 |
| 4,077,625 | 3/1978 | Clarke . | |
| 4,213,213 | 7/1980 | Burnett | 297/452.17 |
| 4,493,877 | 1/1985 | Burnett | 5/913 |
| 4,943,066 | 7/1990 | Lathim et al. . | |
| 5,026,054 | 6/1991 | Osher et al. . | |
| 5,035,425 | 7/1991 | Edwards . | |
| 5,566,953 | 10/1996 | Arriola et al. . | |
| 5,848,946 | 12/1998 | Stillinger | 473/594 |

*Primary Examiner*—Steven Wong
*Attorney, Agent, or Firm*—Reising, Ethington, Barnes, Kisselle, Learman & McCulloch, P.C.

[57] ABSTRACT

A game ball (10) including a large collapsible outer shell (12) partially filled with filler material (14). The game ball (10) includes a selectively closeable aperture (22) adapted to permit insertion and removal of filler material (14) within the outer shell (12). The game ball (10) also includes at least one air vent (34) through the outer shell (12). A game can be played with the ball (10) by having players (16) simultaneously grasp opposing sides of the ball (10) while attempting to move the ball (10) toward a goal area (38,40) and resist movement of the ball (10) toward an opponent's goal area (38,40).

8 Claims, 2 Drawing Sheets

FIG-1
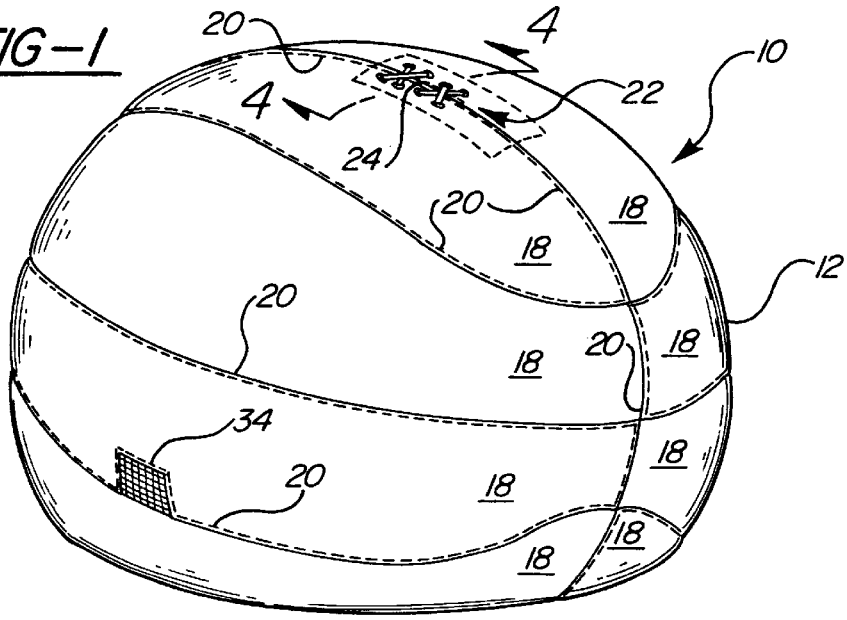
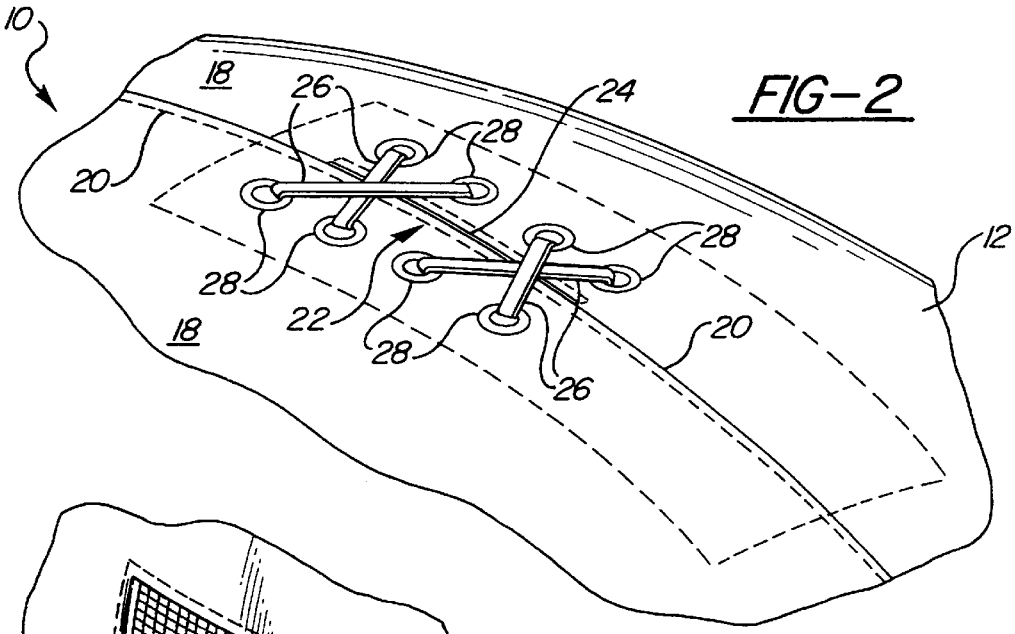
FIG-2
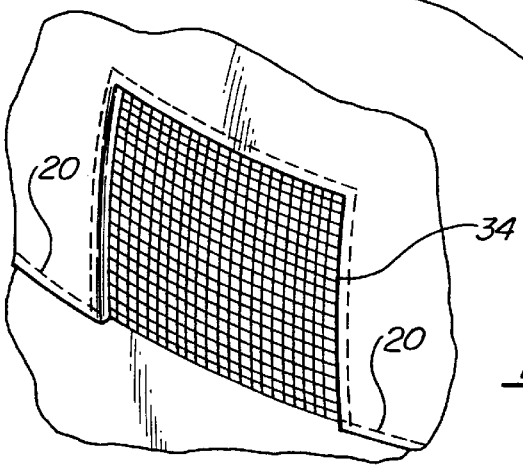
FIG-3

GAME BALL AND METHOD OF PLAYING A GAME

TECHNICAL FIELD

The present invention relates to amusement and sports devices. More specifically, the present invention relates to a game ball and a method of playing a game utilizing the ball.

BACKGROUND OF THE INVENTION

There are a great deal of athletic games available which can test the strength and endurance of competing players. Many of these games, such as wrestling, involve direct physical contact with another player. However, such games may not be appropriate for younger children or for players who are not comfortable with direct physical contact. Further, such games also involve a risk of injury and may require special protective equipment.

Other games are available utilizing various types of game balls to test the strength and skill of opposing players. However, many of these games, such as football and rugby, also involve rigorous physical contact, and thus require expensive protective equipment to reduce the risk of serious injury.

Therefore, it is desirable to provide a game suitable to test the strength, agility, reflexes and endurance of competing players without requiring direct physical contact and with little or no risk of injury to the players.

SUMMARY OF THE INVENTION

The present invention relates to a game ball comprising a collapsible outer shell partially filled with filler material. The filler material comprises a plurality of discrete pieces of foam.

The present invention also relates to a method of playing a game including placing a game ball on a playing surface between first and second goal locations. Opposing players each grasp the ball simultaneously at opposing locations on the ball, and one player attempts to push or pull the ball to the first goal location while another player simultaneously attempts to push or pull the ball to the second goal location.

The invention also includes a method of playing a game including placing a game ball on a playing surface having a goal location. Opposing players each grasp the ball simultaneously, and one player attempts to push or pull the ball to the goal location while another player simultaneously pushes or pulls on the ball to prevent the ball from being moved to the goal location.

Thus, the present invention provides an improved game ball and game which can be used to test the strength, agility, reflexes and endurance of competing players without requiring direct physical contact between the players and without presenting a significant risk of injury to the players.

DESCRIPTION OF THE DRAWINGS

A complete understanding of this invention may be obtained from the following detailed description taken with the accompanying drawings wherein:

FIG. 1 is a perspective view of the game ball of the present invention;

FIG. 2 is a partial view of the game ball illustrating the selectively closeable aperture within the outer shell of the game ball;

FIG. 3 is a partial view of the game ball illustrating the air vent within the outer shell of the game ball;

DETAILED DESCRIPTION OF THE INVENTION

Figure 4:
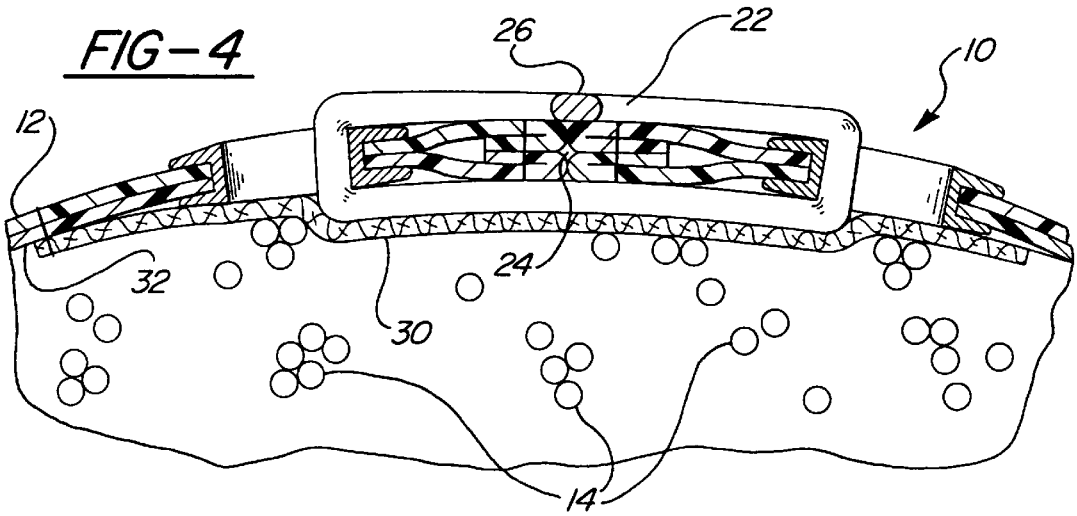
FIG. 4 is a partial sectional view of the game ball taken along line 4—4 of FIG. 1.

Referring now to the figures, the present invention generally relates to a game ball 10 and a game adapted to be played with the game ball 10. As shown in FIGS. 1 and 4, the game ball 10 comprises a collapsible outer shell 12 containing a quantity of filler material 14. The filler material 14 preferably comprises a foam such as a commercially available urethane-ether of 2.55 density, for example one sold under the Luxfoam mark, cut into two-inch cubes. The foam is selected to be relatively light weight compared to, for example, standard couch foam.

Figure 5:
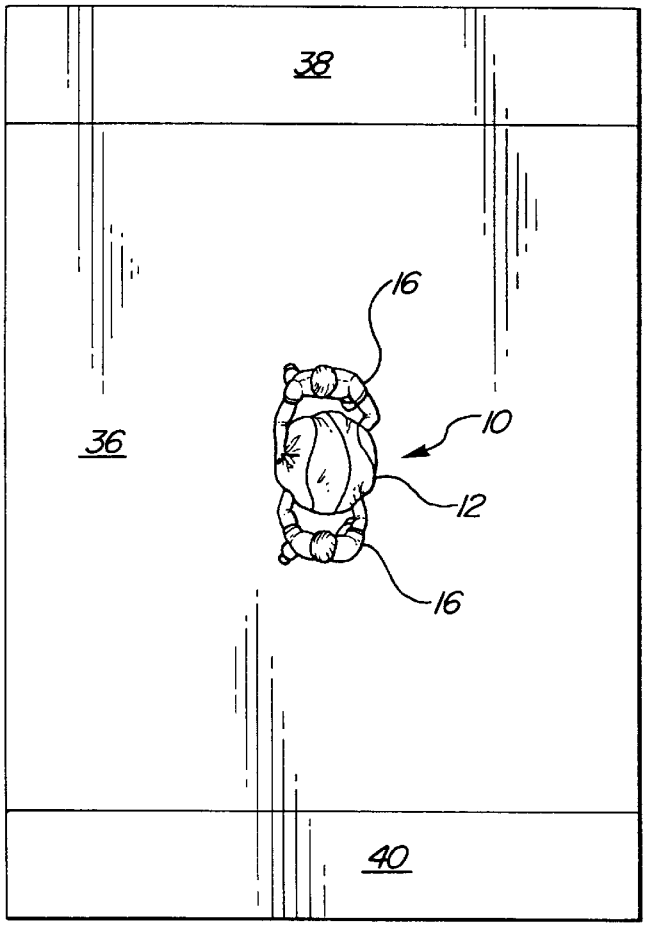
FIG. 5 is an overhead view of a playing surface on which the game of the present invention may be played showing two players engaged with the game ball.

As shown in FIGS. 1 and 5, the shell 12 is only partially filled with filler material 14 and forms a loose outer skin of the ball 10 which can be easily grasped by a player 16. If the shell 12 were completely filled, the shell 12 would be tightly stretched and very difficult to grasp. The shell 12 defines a generally spherical shape for the game ball 10. However, because the shell 12 is only partially filled, it takes the shape of a flattened sphere with rounded sides and flat top and bottom surfaces.

The outer shell 12 is preferably made from a smooth, waterproof and tear-resistant material such as vinyl coated nylon panels 18 stitched together to form a sphere. The panels 18 are coated on both sides with vinyl, and this material is sold commercially under the trade name Shelterite. Thus, if the game ball 10 is used outdoors or on a dirty playing surface, it can be easily cleaned after use. Although vinyl coated nylon is the preferred material for the shell 12, any durable water resistant material would be appropriate.

As shown in FIG. 1, the shell 12 is formed from eight panels 18 which are sewn together along seams 20. The individual panels 18 are of any appropriate shape such that, when joined, they form the desired generally spherical shape for the shell 12. Similarly, any number of panels 18 can be used to form the shell 12 as long as the panels 18 combine to form a spherical shape. The seams 20 between the panels may be also sealed to further enhance the moisture resistance of the shell 12.

As shown in FIGS. 2 and 4, the game ball 10 includes a selectively closeable aperture 22 for permitting expeditious insertion and removal of the filler material 14 within the ball 10. The aperture 22 comprises a slit 24 extending along a seam 20 between two adjacent panels 18 and is selectively closed with lacing 26 threaded through a plurality of eyelets 28. The lacing 26 runs crisscross from side to side across the aperture 22 to pull the panels 18 together on either side of the aperture 22. Even when closed, however, the aperture 22 serves as a vent to permit air to enter and exit the shell 12. As shown in FIG. 4, a rectangular piece of nylon mesh 30 is joined to one of the panels 18 adjacent the aperture 22 on an inside surface 32 of the shell 12 and serves as a barrier to prevent inadvertent loss of filler material 14 through the aperture 22 if the aperture 22 is not tightly closed.

The ball 10 can be filled with any amount of material 14 that is appropriate depending upon the desired difficulty in playing the game. For example, if it is desired to make the game ball 10 particularly easy to grasp, for example with one hand, a lower quantity of filler material 14 will be placed within the ball 10 to permit the shell 12 to form a very loose skin. If it desired to make it more difficult to grasp the game ball 10, i.e. two hands or two clenching arms being needed, the ball 10 can be more completely filled or even totally filled. In the preferred embodiment, however, the shell 12 is filled with filler material 14 to about 80–90% of the total volume of the shell 12 to form a ball that weighs approximately 20 lbs.

As shown in FIGS. 1 and 3, the game ball 10 includes at least one air vent 34 comprising a small section of commercially available nylon mesh securely stitched within one of the panels 18. The vent 34 works in conjunction with the aperture 22 and allows air into and out of the game ball 10 to permit the game ball 10 to collapse during play. The vent 34 has sufficiently small openings to prevent the filler material 14 from passing through the vent 34 while permitting free flow of air within the shell 12. In lieu of a discrete vent 34 in one of the panels 18, the seams could be designed to permit air to flow into and out of the shell 12.

It is important that air be allowed to enter and exit the ball 10 through the vent 34 and aperture 22. Otherwise, if a person jumped on the ball 10 or otherwise applied great pressure to the ball 10, the seams 20 could split due to the increased pressure in the ball 10. During use, it is possible that either the vent 34 or aperture 22 could be blocked due to the contact with the ground. Therefore, the vent 34 and aperture 22 are sufficiently spaced apart to ensure that both cannot be simultaneously blocked by contact with the ground.

As shown in FIG. 5, the game ball 10 is of a size adapted to be grasped between the outstretched arms of a person 16 during play. In other words, the game ball 10 is designed to completely fill the generally semi-circular area defined by a person's arms and chest when they are outstretched to grasp the game ball 10 such that the person 16 can reach approximately half-way around the game ball 10. The game ball 10 preferably has a diameter of approximately three feet across. For smaller or younger children, a smaller ball of 1–2 feet in diameter may suffice with accordingly lighter weight.

Because the game ball 10 is collapsible, it will not bounce when it contacts the ground. Thus, the ball 10 must be pushed, pulled, or carried, if possible, from one location to another. The ball 10 will either slide or roll when pushed or pulled depending upon the manner in which it is engaged.

The present invention also includes a game using the game ball 10 described above. As shown in FIG. 5, the game ball 10 is first placed on a playing surface 36 between a first goal location 38 and a second goal location 40. While the playing surface 36 can comprise a marked area on any field, a designated area on a basketball court, a wrestling mat, or the like, it is preferred to have a soft cushioned playing surface such as a wrestling mat for indoor play or a soft grassy field for outdoor play. The goal locations 38,40 can comprise either predefined areas at the edges of the playing surface 36, discrete zones within the playing surface 36, or even the entire area beyond a designated edge of the playing surface 36.

After the ball 10 is placed on the playing surface 36, two players 16 each grasp the ball 10 simultaneously at opposing locations on the ball 10. Each player 16 is assigned one of the goal locations 38,40, and after the players 16 are instructed to begin they will simultaneously attempt to move the ball 10 to their assigned goal location and resist movement of the ball 10 to their opponent's goal location. A referee may be used to call for improper moves such as when a player 16 lets go of the ball 10 and intentionally makes direct body contact with the opposing player 16. In this circumstance, the referee would reset the players with each holding onto the ball 10. One player 16 may push, shove, roll, pull or jerk the ball 10 to render the opposing player off balance or otherwise to overcome the resistance of the other player 16 in order to move the ball 10 toward the desired goal 38,40.

A player 16 may even sit on the ball 10 for providing a defensive posture to prevent the ball from moving but must be alert against efforts to be forced off balance by the other player 16 attempting to roll the ball 10. Play continues until either a set time limit has expired or until one player 16 succeeds in placing the game ball 10 within his or her designated goal location 38,40. If the ball 10 is not placed within a goal location 38,40 before a predetermined time expires, a draw is declared.

Alternatively, the game can be played by having only one goal location which comprises any area outside the boundary of the playing surface 36. In this situation, one player 16 would be assigned the task of moving the game ball 10 off of the playing surface while the other player 16 attempts to keep the game ball 10 on the playing surface 36.

Further, although the game has been described for play by two players, the game could be played with three or more players particularly if a larger game ball 10 is used.

Although the description of this invention has been given with reference to a particular embodiment, it is not to be construed with a limiting sense. Many variations and modifications will no doubt occur to those skilled in the art. For a definition of the invention, reference is made to the appended claims.

What is claimed is:

1. A game ball characterized by:

a collapsible outer shell;

said outer shell being partially filled with filler material; and said filler material comprising a plurality of discrete pieces of foam;

said outer shell including at least one selectively re-openable and closeable aperture constructed to permit insertion and removal of said filler material within said game ball and constructed to provide a vent for said shell even when said aperture is closed;

a mesh material positionable to underlie said aperture to prevent filler material from undesirably passing through said aperture while still maintaining the vent for the shell.

2. A game ball as defined in claim 1 further characterized by:

said outer shell includes at least one air vent therethrough spaced sufficiently from said aperture to ensure that both said vent and said aperture cannot be simultaneously blocked by contact with a playing surface;

said at least one air vent being a port screened with mesh material to prevent said filler material from undesirably pas sing out of said game ball.

3. The game ball as defined in claim 2 further characterized by:

said filler material occupies about 80 to 90% of the total volume of the shell.

4. The game ball as defined in claim 2 further characterized by:

said ball sized to fill the area defined between the outstretched arms of a person in play.

5. The game ball defined in claim 4 wherein said ball has a diameter of approximately three feet across.

6. The game ball defined in claim 4 wherein said shell in an uncollapsed state has a generally spherical shape.

7. The game ball defined in claim 1 wherein said shell comprises a plurality of panels joined together along seams and said at least one vent being a through one of the panels.

8. A game ball characterized by:

a collapsible outer shell;

said outer shell being partially filled with filler material; and said filler material comprising a plurality of discrete pieces of foam;

said outer shell including at least one selectively re-openable and closeable aperture constructed to permit insertion and removal of said filler material within said game ball and constructed to provide a vent for said shell even when said aperture is closed;

said outer shell includes at least one air vent therethrough spaced sufficiently from said aperture to ensure that both said vent and said aperture cannot be simultaneously blocked by contact with a playing surface;

said at least one air vent being a port screened with mesh material to prevent said filler material from undesirably passing out of said game ball;

said shell comprises a plurality of panels joined together along seams and said at least one vent being a through one of the panels.

* * * * *